US007171724B2

(12) United States Patent
Follegot et al.

(10) Patent No.: US 7,171,724 B2
(45) Date of Patent: Feb. 6, 2007

(54) MULTIFUNCTIONAL ELECTRIC CLEANING APPARATUS

(75) Inventors: Rodolfo Follegot, Pasiano Di Pordenone (PN) (IT); Francesca Cester, Treviso (IT)

(73) Assignee: De' Longhi SpA, Treviso (IT)

( * ) Notice: Subject to any disclaimer, the term of this patent is extended or adjusted under 35 U.S.C. 154(b) by 0 days.

(21) Appl. No.: 11/283,552

(22) Filed: Nov. 18, 2005

(65) Prior Publication Data

US 2006/0070208 A1 Apr. 6, 2006

Related U.S. Application Data

(63) Continuation of application No. PCT/IB04/01620, filed on May 19, 2004.

(30) Foreign Application Priority Data

May 20, 2003 (IT) ..... UD2003A0107

(51) Int. Cl.
*A47L 7/00* (2006.01)

(52) U.S. Cl. ..... 15/329; 15/344; 15/410; 15/414

(58) Field of Classification Search ..... 15/344, 15/328, 410, 329, 414
See application file for complete search history.

(56) References Cited

U.S. PATENT DOCUMENTS

| | | | | |
|---|---|---|---|---|
| 2,123,813 | A * | 7/1938 | Stiles | 15/410 |
| 6,374,453 | B1 * | 4/2002 | Kim | 15/328 |
| 6,779,229 | B2 * | 8/2004 | Lee et al. | 15/329 |

FOREIGN PATENT DOCUMENTS

| | | | |
|---|---|---|---|
| DE | 16 28 478 | A | 10/1971 |
| EP | 1 033 101 | A | 9/2000 |
| FR | 1221757 | A | 6/1960 |

* cited by examiner

*Primary Examiner*—Theresa T. Snider
(74) *Attorney, Agent, or Firm*—Akin Gump Strauss Hauer & Feld, LLP

(57) ABSTRACT

An electric cleaning apparatus (10) having a suction body (11), which is provided at one end with a suction aperture (13) connected to a suction drive member arranged inside the suction body (11), and to which a terminal suction element (32) is able to be selectively associated. The electric cleaning apparatus (10) includes tubular members (16, 21) pivoted on the suction body (11) and able to be selectively rotated with respect to the latter in order to define a first operating configuration, wherein the tubular members (16, 21) are arranged on the opposite side with respect to the suction aperture (13) in order to function as a remote handgrip for the suction body (11), and a second operating configuration, wherein the tubular members (16, 21) cooperate with the suction aperture (13) in order to function as an extension for the terminal suction element (32).

10 Claims, 3 Drawing Sheets

MULTIFUNCTIONAL ELECTRIC CLEANING APPARATUS

CROSS-REFERENCE TO RELATED APPLICATIONS

This application is a continuation of International Application No. PCT/IB2004/001620, filed May 19, 2004, which was published in the English language on Dec. 2, 2004, under International Publication No. WO 2004/103144 A1, and the disclosure of which is incorporated herein by reference.

BACKGROUND OF THE INVENTION

The present invention concerns a multifunctional electric cleaning apparatus, able to be used as an electric brush, a vacuum cleaner and a crumb vacuumer. To be more exact, the present invention comprises a fork element which allows to direct a suction pipe to one side or the other of the central body of the apparatus, in order to selectively use the pipe as a handle for the electric brush, or as a rigid extension of the vacuum cleaner. Moreover, such fork element can be detached from the central body so that the latter can be used as a crumb vacuumer.

Electric cleaning apparatuses are known, such as for example vacuum cleaners, electric brushes, crumb vacuumers or suchlike, used in household cleaning.

Such known electric cleaning apparatuses normally have a suction body provided with an electric motor which creates the suction, and a multitude of accessories, such as suction pipes, handles, handgrips, suction brushes or otherwise, arranged according to the specific function of the electric cleaning apparatus used.

Known electric cleaning apparatuses, however, have rigid structures and configurations, that is, they do not offer the possibility of being widely personalized by the user according to the operations he wants to execute. For example, in the case of an electric brush, wherein the suction body is associated at one of its ends to a handle, and at the other end to a brush, operations to suck up the dirt from gaps underneath the piece of furniture are almost impossible, since the proximity of the suction body and the brush prevents the latter from being inserted in depth under the piece of furniture.

This shortcoming is normally solved by providing the user with a kit of auxiliary accessories, such as extensions or suchlike, but this entails the need to remove and reassemble the brush and the various accessories each time a different cleaning situation occurs. Moreover, it is evident that such an electric brush proves to be extremely awkward for cleaning crumbs or dust from a surface, such as for example that of a table, of a shelf, or suchlike.

These shortcomings therefore entail the need, on the part of the user, to buy different electric cleaning apparatuses, according to the type of cleaning to be done.

Apart from being very expensive, this is both inconvenient, as the user finds himself having to change apparatus according to what operations he has to carry out, and also bulky, as the various apparatuses, when not in use, take up large spaces in cupboards or repositories.

One purpose of the present invention is to achieve a multifunctional electric cleaning apparatus which will allow to carry out cleaning operations in a simple, practical and at the same time effective manner, both on elevated surfaces, free environments, and in the gaps underneath pieces of furniture or otherwise, without needing to assemble auxiliary accessories or to change the electric cleaning apparatus itself according to the different operating conditions.

Applicant has devised, tested and embodied the present invention to overcome the shortcomings of the state of the art and to obtain this and other purposes and advantages.

BRIEF SUMMARY OF THE INVENTION

The present invention is set forth and characterized in the main claim, while the dependent claims describe other characteristics of the present invention or variants to the main inventive idea.

An electric cleaning apparatus according to the present invention has a suction body provided at one end with at least a suction aperture, or hole, connected to a suction drive member arranged inside the suction body itself, and at least a terminal suction element, such as a brush or suchlike, able to be selectively associated to the suction hole.

According to a characterizing aspect, and in accordance with the purpose as above, the electric cleaning apparatus according to the present invention has tubular means pivoted on the suction body which are selectively rotated to define at least a first operating configuration, wherein they are arranged on the opposite side with respect to the suction hole in order to function as a remote handgrip for the suction body, and at least a second operating configuration, wherein they cooperate with the suction hole in order to function as an extension of the terminal suction element.

The tubular means has at least a fork element connected to a tubular element; such fork element is provided with pivoting means of the removable type which allow it to be selectively coupled to the suction body, so that the tubular means can be removed and the suction body can assume a third operating position in which it can function autonomously.

According to the invention, the terminal suction element is selectively associated to the suction hole in the first operating configuration, or to the tubular means in the second operating configuration.

In this way, the electric cleaning apparatus according to the present invention can be used both as an electric brush, in the first operating configuration, and also as a vacuum cleaner, in the second operating configuration, and also as a crumb vacuumer, when the suction means are removed to define the third operating configuration.

With the present invention it is therefore possible, with a single electric cleaning apparatus, to carry out normal cleaning operations in free environments in the first operating configuration, and also cleaning operations in the gaps underneath pieces of furniture in the second operating configuration, and also cleaning operations on surfaces of tables, shelves or suchlike in the third operating configuration.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 2A:
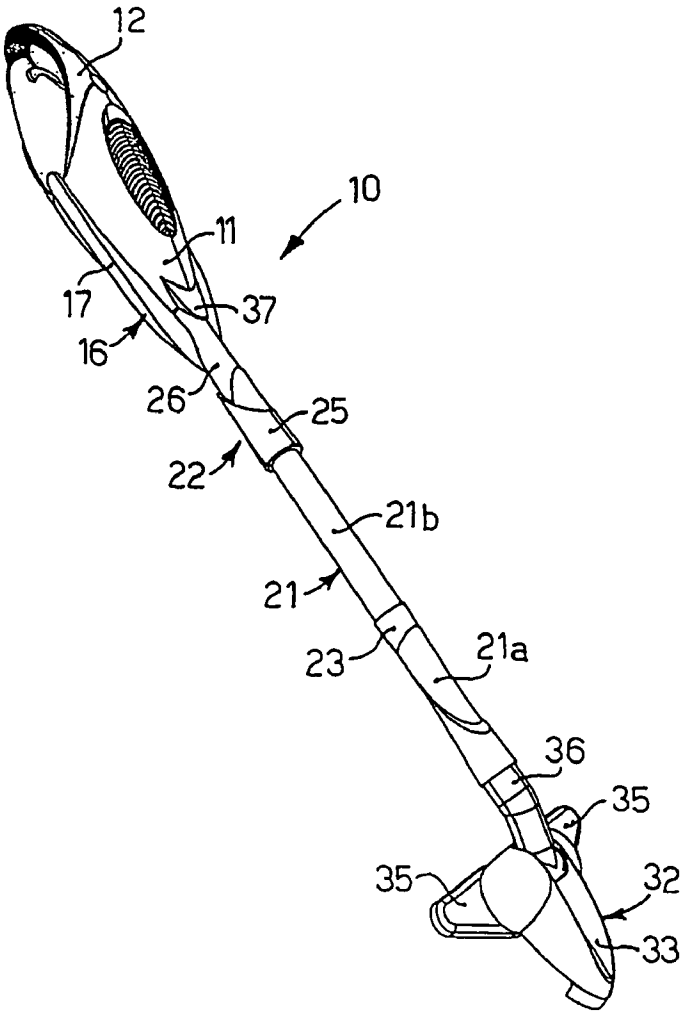
FIGS. 2*a* and 2*b* are two three-dimensional views of the electric cleaning apparatus in FIG. 1 in a second operating configuration.
Figure 1:
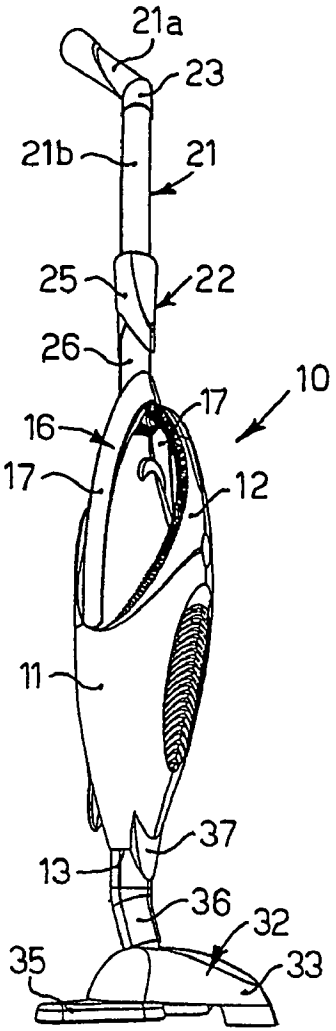
FIG. 1 is a three-dimensional view of an electric cleaning apparatus according to the present invention in a first operating configuration.
Figure 2B:
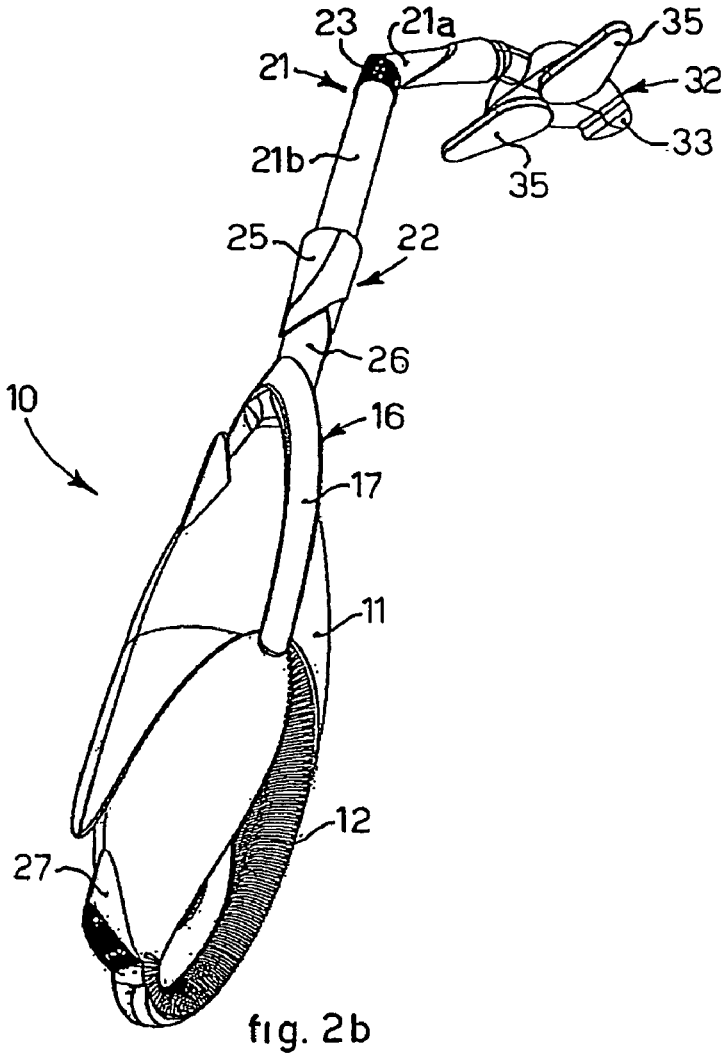

With reference to FIG. 1, an electric cleaning apparatus 10 according to the present invention has a suction body 11 of a substantially oval shape, inside which an electric suction drive member is arranged, of a known type and not shown in the drawings. Externally the suction body 11 has a handle 12, in proximity with which the commands of the internal drive member are advantageously arranged.

On the side opposite the handle 12, the suction body 11 is provided with a suction aperture, or hole, 13, connected to the internal drive member and through which it is possible to suck in dirt or dust.

Figure 3:
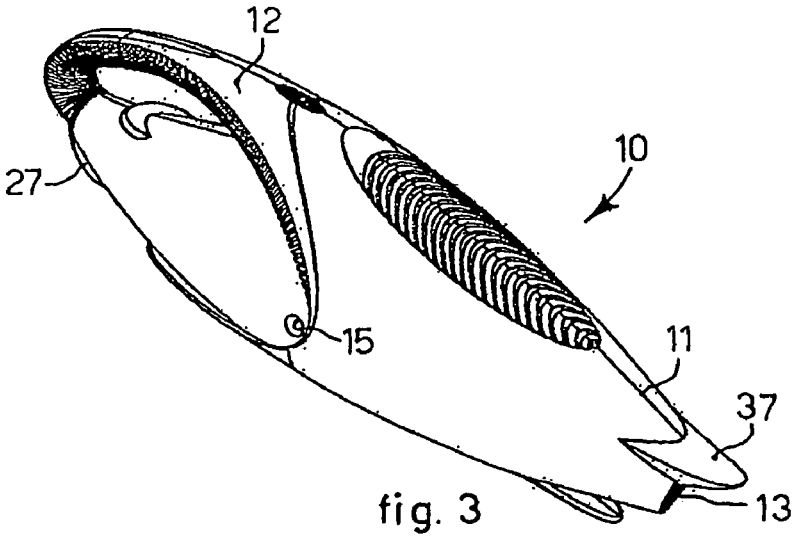
FIG. 3 is a three-dimensional view of the electric cleaning apparatus in FIG. 1 in a third operating configuration.
Figure 4:
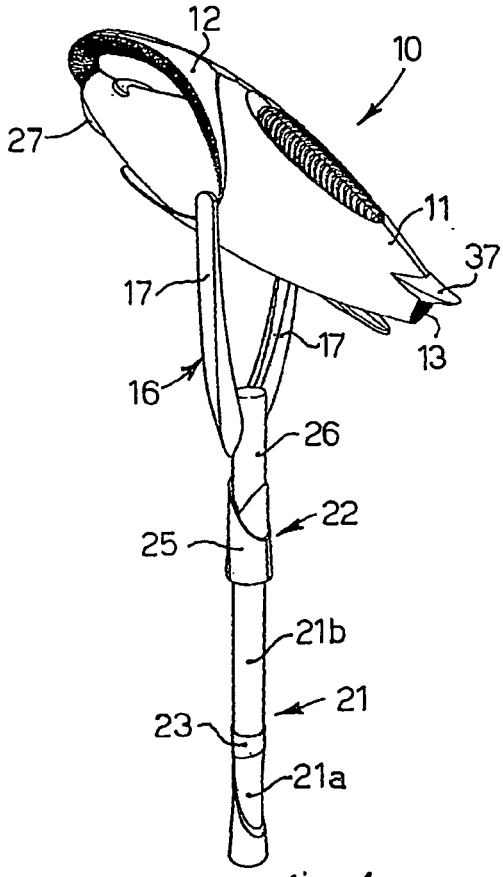
FIG. 4 is a three-dimensional view of the electric cleaning apparatus in FIG. 1 in an intermediate configuration.
Figure 5:
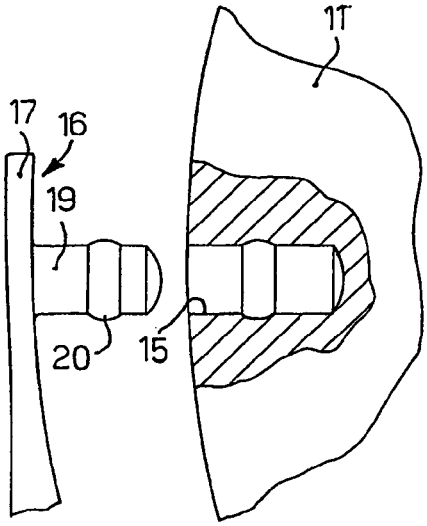
FIG. 5 shows an exploded enlarged detail of the electric cleaning apparatus in FIG. 1.

At the sides of the suction body 11 two housing seatings 15 (FIG. 3) are made, on opposite sides, by means of which it is possible to selectively associate a fork 16 to the suction body 11.

The fork 16 (FIGS. 1,2*a*, 2*b*, 5) is made of partially elastic material and has two arms 17, at the free ends of which respective pins 19 are arranged. Such pins 19 can be selectively coupled, with play with respect to the corresponding housing seatings 15, so as to allow the fork 16 to rotate with respect to the suction body 11.

Furthermore, the pins 19 are provided with a snap-in element 20, of a known type, for example with a circumferential relief. Such snap-in element 20 guarantees a stable coupling with the housing seatings 15 and, at the same time, allows the user to easily extract the pins 19 from the housing seatings 15, possibly to selectively detach the fork 16 from the suction body 11.

A tubular element 21, advantageously made of aluminum, is fixed to the fork 16, in proximity with the point of connection of its two arms 17. In correspondence with the point of connection, the tubular element 21 is provided with a coupling 22. The latter allows to couple the tubular element 21 with the suction hole 13, or to temporarily constrain the tubular element 21 itself to a terminal part of the handle 12. The tubular element 21, on the opposite side with respect to the coupling 22, has a terminal segment 21*a* connected to a central part 21*b* by means of an articulated joint 23. In this way the terminal segment 21*a* can be positioned straight or at an angle with respect to the central part 21*b* of the tubular element 21.

When at an angle the terminal segment 21*a* may carry out the function of handgrip.

Figure 6:
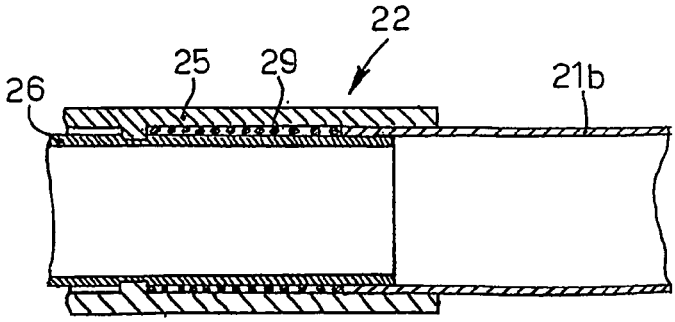
FIG. 6 shows an enlarged and partially sectioned detail of the electric cleaning apparatus in FIG. 1.

The coupling 22 (FIG. 6) comprises an external body 25, able to slide axially with respect to the central part 21*b* of the tubular element 21, and attached to a terminal connection 26 arranged coaxially inside the tubular element 21. In this way it is possible to selectively insert the terminal connection 26 in the suction hole 13, or to selectively constrain such terminal connection 26 to an attachment element 27 arranged in proximity with the terminal part of the handle 12.

The coupling 22 also comprises a helical spring 29 which allows an automatic return of the external body 25, and consequently of the terminal connection 26, to a position wherein it maintains the latter normally inserted in the respective suction hole 13 or constrained to the respective attachment element 27.

The articulated joint 23 is substantially of the known type and consists of a rotating coupling between the end of the central part 21*b* of the tubular element 21 and the terminal segment 21*a*. To be more exact, these ends are transversally cut diagonally with respect to the longitudinal axis of the tubular element 21, so that the central part 21*b* and the terminal segment 21*a* can be reciprocally rotated between a first position wherein they are substantially coaxial, and a plurality of other positions wherein they are at an angle with respect to each other.

The electric cleaning apparatus 10 according to the invention also has a brush 32, for example of the type described in U.S. Pat. No. 6,536,076, wherein said brush comprises a central body 33 provided with two suction arms 35 revolving with respect to the central body 33, which maintain the suction surface constant for any position whatsoever thereof.

Such brush 32 also has a pipe 36 by means of which it is selectively connected to the suction hole 13, or to the end of the terminal segment 21*a* of the tubular element 21, depending on the position of the latter with respect to the suction body 11.

The electric cleaning apparatus 10 also has, in proximity with the suction hole 13, a platelet 37 with the double function of a clamp for the fork 16, and of a conveyor for the dirt when the suction is carried out directly by the suction hole 13.

The electric cleaning apparatus 10 as described heretofore can be used in three different operating configurations that will be described herebelow.

A first configuration of the electric cleaning apparatus 10 (FIG. 1) provides to use it as an electric brush, so as to obtain maximum maneuverability and lightness of the apparatus for cleaning free environments, such as floors.

In this configuration, the fork 16 is rotated with respect to the suction body 11, so that the terminal connection 26 of the coupling 22 cooperates with the attachment element 27, while the brush 32 is directly connected to the suction hole 13. By doing so, the terminal segment 21*a* of the tubular element 21 acts as a handgrip for the suction body 11, which, since it is close to the ground, allows for an excellent maneuverability of the apparatus 10, thus enabling the user not to tire himself excessively when using the apparatus 10 itself. Thanks to the articulated joint 23, it is also possible to orientate the terminal segment 21*a* with respect to the central part 21*b* of the tubular element 21, so as to improve the user's grip on the apparatus 10.

A second configuration of the electric cleaning apparatus 10 (FIG. 2*a*) provides to use it as a vacuum cleaner, so as to easily access gaps underneath or above pieces of furniture with the brush 32.

In this configuration, the fork 16 is rotated with respect to the suction body 11, so that the terminal connection 26 of the coupling 22 cooperates with the suction hole 13, while the brush 32 is connected to the terminal segment 21*a* of the tubular element 21. By doing so, the tubular element 21 acts as an extension for the brush 32, which can thus be inserted easily and completely into the gaps underneath pieces of furniture.

In this second configuration, the apparatus 10 is held by the user by means of the handle 12.

By rotating the terminal segment 21*a* (FIG. 2*b*) with respect to the central part 21*b*, an angled position of the brush 32 with respect to the tubular element 21 is defined, so as to facilitate cleaning operations of surfaces arranged above wardrobes, without needing to use ladders or footstools.

A third configuration of the electric cleaning apparatus 10 (FIG. 3) provides to use it as a crumb vacuumer, so as to have maximum compactness and maneuverability in order to facilitate cleaning operations on tables, shelves, internal surfaces of cars, sofas or otherwise, where the use of an electric brush or a vacuum cleaner is awkward and bulky.

In this configuration, the fork 16 is widened elastically in order to remove the pins 19 from the relative housing seatings 15. In this way, by means of the handle 12, the user grips the suction body 11 which, due to its limited dimensions, can be easily manipulated to vacuum surfaces such as tables, shelves, internal surfaces of cars, sofas or otherwise. To further reduce the bulkiness of the apparatus 10, during this phase the brush 32 can also be removed, so as to suck in dirt directly through the suction hole 13 using the platelet 37 as a conveyor.

It is clear, however, that modifications and/or additions of parts can be made to the electric cleaning apparatus 10 as described heretofore, without departing from the field and scope of the present invention.

For example, according to a variant, the tubular element 21 can be of the telescopic type, or can contain a flexible part able to be used selectively in the second configuration as a vacuum cleaner.

According to another variant, the suction body 11 could be provided with wheels which allow it to be dragged. The oval shape of the suction body 11 may also be changed, so that it can therefore be spherical, parallelepiped, cylindrical or otherwise.

According to a further variant, the coupling 22 may be provided, in the internal part of the external body 25, with a stopping tooth which, cooperating with a mating circular seating made on the tubular element 21, allows to temporarily stop the external body 25 bayonet-manner in a position wherein the terminal connection is released/unconstrained from the suction hole 13 or from the attachment element 27.

It is also clear that, although the present invention has been described with reference to specific examples, a person of skill in the art shall certainly be able to achieve many other equivalent forms of a multifunctional electric cleaning apparatus, all of which shall come within the field and scope of the present invention.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. Electric cleaning apparatus comprising a suction body, which is provided at one end with at least a suction aperture connected to a suction drive member arranged inside said suction body, and to which at least one terminal suction element is able to be selectively connected thereto, wherein tubular means are pivoted on said suction body and for selective rotation with respect to said suction body in order to define at least a first operating configuration, in which said tubular means are arranged on the opposite side with respect to said suction aperture in order to function as a remote handgrip for said suction body, and at least a second operating configuration, in which said tubular means cooperate with said suction aperture in order to function as an extension for said terminal suction element.

2. Apparatus as in claim 1, wherein said tubular means comprise a tubular element and a fork element connected to one end of said tubular element and pivoted in a substantially median zone of said suction body.

3. Apparatus as in claim 2, wherein said fork element comprises pivoting means of the removable type, for selective coupling thereof with said suction body, so that said tubular means are able to be removed and said suction body is able to assume a third operating configuration in which it is able to operate autonomously.

4. Apparatus as in claim 3, wherein said suction body comprises a handle able to allow said suction body to be gripped both in said second operating configuration and also in said third operating configuration.

5. Apparatus as in claim 2, wherein said tubular element comprises a coupling element able to selectively cooperate with said suction aperture in said first operating configuration, or with an attachment element arranged on said suction body, on the opposite side with respect to said suction aperture, in said second operating configuration.

6. Apparatus as in claim 5, wherein said tubular element comprises at least two segments connected to each other by an articulated joint able to allow the selective angular positioning of a first terminal segment with respect to a second segment of said tubular element, in said first operating configuration, and to allow said terminal suction element to be arranged at an angle in said second operating configuration.

7. Apparatus as in claim 3, wherein said suction body has a substantially oval shape and comprises, in proximity with the substantially median zone, a couple of housing seatings arranged on opposite sides, and able to accommodate said pivoting means of said fork element in removable manner.

8. Apparatus as in claim 7, wherein said pivoting means comprise two pins arranged each one at one end of a respective arm of said fork element, and able to be selectively coupled in a rotating manner inside said housing seatings.

9. Apparatus as in claim 8, wherein each of said pins comprises a pressure-type snap-in element able to guarantee the temporary coupling of said fork element with said suction body.

10. Apparatus as in claim 1, wherein said terminal suction element comprises a brush, which is able to be selectively connected to said suction aperture in said first operating configuration, or to said tubular means in said second operating configuration.

* * * * *